United States Patent [19]

Edwards et al.

[11] Patent Number: 4,734,221

[45] Date of Patent: Mar. 29, 1988

[54] DETERGENT COMPOSITIONS

[75] Inventors: Robert J. Edwards; Paul D. Hardman, both of Merseyside; Melvin Scott, Cheshire; Carey J. Walsh; Peter Winterbotham, both of Merseyside, all of England

[73] Assignee: Lever Brothers Company, New York, N.Y.

[21] Appl. No.: 5,366

[22] Filed: Jan. 14, 1987

Related U.S. Application Data

[63] Continuation of Ser. No. 727,495, Apr. 26, 1985, abandoned.

[30] Foreign Application Priority Data

May 11, 1984 [GB] United Kingdom ..... 8412048
Oct. 26, 1984 [GB] United Kingdom ..... 8427160

[51] Int. Cl.[4] ..... C11D 1/29; C11D 1/37; C11D 3/43; C11D 17/08

[52] U.S. Cl. ..... 252/544; 252/153; 252/173; 252/174.17; 252/174.21; 252/548; 252/551; 252/552; 252/557; 252/DIG. 14

[58] Field of Search ..... 252/153, 173, 174.17, 252/174.21, 548, 551, 552, 557, DIG. 13; 251/DIG. 14

[56] References Cited

U.S. PATENT DOCUMENTS 3,919,125 11/1975 Ashina ..... 252/551
4,243,549 1/1981 Messenger ..... 252/153

FOREIGN PATENT DOCUMENTS 140710 5/1985 European Pat. Off. .
1429637 3/1976 United Kingdom .
1437095 5/1976 United Kingdom .
2021141 11/1979 United Kingdom .
2105325 3/1983 United Kingdom .
2104913 3/1983 United Kingdom .
2108520 5/1983 United Kingdom .
2130238 5/1984 United Kingdom .
2130236 5/1984 United Kingdom .
2133793 8/1984 United Kingdom .

OTHER PUBLICATIONS

McCutcheon's Emulsifiers & Detergents, 1983, No. Amer. Ed., 1983, MC Publishing Co., Glen Rock, N.J. 07452, pp. 65, 66, 91, 100, 140 & 236.

*Primary Examiner*—Dennis Albrecht
*Attorney, Agent, or Firm*—Milton L. Honig; James J. Farrell

[57] ABSTRACT

Stable, high-concentration (60–80% active matter) aqueous liquid detergent compositions based on dialkyl sulphosuccinates and alkyl ether sulphates contain a lower alcohol, preferably ethanol, and water, the ratio of lower alcohol to water exceeding a critical ratio which varies with the total active detergent content. The compositions may be thickened by means of hydroxypropyl guars, polyethylene oxides, or hydrophilically substituted cellulosic polymers such as hydroxyethyl cellulose.

23 Claims, No Drawings

DETERGENT COMPOSITIONS

This is a continuation application of Ser. No. 727,495, filed Apr. 26, 1985, now abandoned.

The present invention relates to foaming liquid detergent compositions based on dialkyl sulphosuccinates and alkyl ether sulphates, and containing relatively high concentrations of active detergent.

GB No. 1 429 637 (Unilever) discloses liquid and powdered detergent compositions having excellent foaming properties and containing $C_7$–$C_9$ dialkyl sulphosuccinates together with alkyl sulphates or alkyl ether sulphates. Although it is stated that the concentration of active detergent may range from 5 to 100%, the range of 10 to 60% is preferred and the highest concentration exemplified for a liquid is 40%.

GB No. 2 130 238A (Unilever), published on 31 May 1984, discloses liquid detergents, having active detergent levels of from 2 to 60% by weight, based on dialkyl sulphosuccinates in combination with certain optimum alkyl ether sulphates containing 20% or less material of a chain length of $C_{14}$ or above.

Difficulties have been experienced when attempting to formulate liquid detergents of high concentration from this combination of detergent-active materials. At concentrations above about 50% by weight it has proved difficult to obtain single-phase isotropic liquids stable over a reasonable temperature range and having acceptable viscosities. Frequently phase separation will occur, even when large quantities of urea are present as a hydrotrope, and when a single phase system is obtained its cloud point tends to be too high.

It has now been discovered that it is possible to formulate liquids successfully using this particular combination of active detergents at concentration levels in the 60 to 80% by weight range provided that the electrolyte level is maintained below a certain value and provided that a fairly substantial proportion of a lower alcohol, preferably ethanol, is present.

The present invention accordingly provides a homogeneous foaming liquid detergent composition consisting essentially of (a) from 60 to 80% by weight of an active detergent system consisting essentially of

[i] a water-soluble salt of a $C_3$–$C_{12}$ dialkyl ester of sulphosuccinic acid in which the alkyl groups may be the same or different,

[ii] a $C_{10}$–$C_{18}$ alkyl ether sulphate, the ratio of [i] to [ii] being from 4:1 to 0.5:1, and

[iii] optionally a nonionic detergent, in an amount not exceeding 15% by weight of the whole composition, (b) a $C_2$–$C_3$ mono- or polyhydric alcohol, (c) optionally from 0 to 12% by weight of urea, and (d) water and minor ingredients to 100%, the ratio of (b) to water exceeding a critical value r, dependent on the total active detergent comcentration, below which separation into two phases occurs.

The total active detergent concentration in the composition of the invention is preferably within the range of from 60 to 70% by weight, more preferably from 63 to 70% by weight.

The present invention is based on the discovery that stable liquid compositions can be obtained at these high levels of dialkyl sulphosuccinate and alkyl ether sulphate, provided that the ratio of lower alcohol to water exceeds a certain critical value r which is related to the total active detergent level; at ratios below this value separation into two or more phases occurs.

In the compositions of the invention the active detergent system contains two essential ingredients. The first is a water-soluble salt of a dialkyl ester of sulphosuccinic acid, hereinafter referred to for simplicity as a dialkyl sulphosuccinate.

The detergent-active dialkyl sulphosuccinates used in the compositions of the invention are compounds of the formula I:

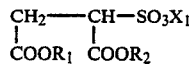

wherein each of $R_1$ and $R_2$, which may be the same or different, represents a straight-chain or branched-chain alkyl group having from 3 to 12 carbon atoms, preferably from 4 to 10 carbon atoms, and advantageously from 6 to 8 carbon atoms, and $X_1$ represents a solubilishing cation, that is to say, any cation yielding a salt of the formula I sufficiently soluble to be detergent-active. The solubilising cation $X_1$ will generally be monovalent, for example, alkali metal, especially sodium.

The alkyl groups $R_1$ and $R_2$ are preferably straight-chain or (in mixtures) predominantly straight-chain.

The dialkyl sulphosuccinate component of the composition of the invention may if desired be constituted by a mixture of materials of different chain lengths, of which the individual dialkyl sulphosuccinates themselves may be either symmetrical (both alkyl groups the same) or unsymmetrical (with two different alkyl groups).

The present invention is of especial applicability to compositions containing dialkyl sulphosuccinate material of more than one chain length. According to a preferred embodiment of the invention, the dialkyl sulphosuccinate used is a mixture of symmetrical and unsymmetrical materials. Such a mixture may conveniently be derived from a mixture of two or more aliphatic alcohols ($R_1OH$, $R_2OH$). The conversion of alcohol mix to dialkyl sulphosuccinate may be carried out by reaction with maleic anhydride followed by bisulphite addition. Dialkyl sulphosuccinate mixtures of this type are disclosed and claimed in GB No. 2 108 520A (Unilever) and GB No. 2 133 793A (Unilever). Of especial interest are dialkyl sulphosuccinates and mixtures thereof having $C_6$, $C_7$ and $C_8$ alkyl groups. $C_6/C_8$ unsymmetrical dialkyl sulphosuccinates are described and claimed in GB No. 2 105 325A, and mixtures of dioctyl and dihexyl sulphosuccinates with other surfactants are described and claimed in GB No. 2 104 913A (Unilever).

The concentration of the dialkyl sulphosuccinate component in the whole composition is preferably within the range of from 20 to 65% by weight, more preferably within the range of from 25 to 55% by weight.

The second essential ingredient of the active detergent system of the composition of the invention is an alkyl ether sulphate. These anionic detergents are materials of the general formula II $$R_3—O—(CH_2CH_2O)_n—SO_3X_2 \qquad (II)$$

wherein $R_3$ is an alkyl group having from 10 to 18 carbon atoms and $X_2$ is a solubilising cation, preferably alkali metal, ammonium substituted ammonium or magnesium, desirably sodium or ammonium. The average degree of ethoxylation n preferably ranges from 1 to 12, more preferably from 1 to 8 and desirably from 1 to 5. In any given alkyl ether sulphate a range of differently ethoxylated materials, and some unethoxylated material (alkyl sulphate), will be present and the value of n represents an average. If desired, additional alkyl sulphate may be admixed with the alkyl ether sulphate to give a mixture in which the ethoxylation distribution is more weighted towards lower values.

The amount of alkyl ether sulphate present in the composition of the invention is preferably within the range of from 12 to 55% by weight, more preferably from 15 to 30% by weight.

According to a a preferred embodiment of the invention, the alkyl ether sulphate contains 20% or less by weight of material of chain length $C_{14}$ and above. As previously indicated, the use of this alkyl ether sulphate together with dialkyl sulphosuccinates in lower-concentration liquid detergents is described and claimed in GB No. 2 130 238A (Unilever). In the alkyl ether sulphate the content of $C_{14}$ and longer-chain material is advantageously less than 10% by weight, and use of a material substantially free of $C_{14}$ and above alkyl groups is especially preferred. An example of such a material is Dobanol (Trade Mark) 23 ex Shell, based on a mixture of approximately 50% each of $C_{12}$ and $C_{13}$ alcohols. The optimum average degree of ethoxylation for alkyl ether sulphates of this preferred type appears to be 2 or 3. In most of our investigations we used Dobanol 23-3A, the ammonium salt having an average degree of ethoxylation of 3.

The two essential components [i] and [ii] of the active detergent system are used in a weight ratio of from 4:1 to 0.5:1, preferably 2.5:1 to 1.5:1.

As previously indicated, one or more nonionic surfactants may optionally be present in the composition of the invention, in an amount not exceeding 15% by weight. A preferred level for the nonionic surfactant is from 7 to 10% by weight.

The nonionic surfactant may advantageously be selected from the following classes:

(a) $C_{10}$–$C_{18}$ alkyl di($C_2$–$C_3$ alkanol)amides, preferably $C_{12}$–$C_{14}$ alkyl diethanolamides, for example, Empilan (Trade Mark) LDE and CDE ex Albright & Wilson and Ninol (Trade Mark) P 621 ex Stepan Chemical Company; and (b) ethoxylated $C_8$–$C_{12}$ primary aliphatic alcohols, for example, Dobanol (Trade Mark) 91-8 ex Shell ($C_9$–$C_{11}$ alcohol, 8 EO).

Mixtures of two or more nonionic surfactants selected from these classes may also be used.

The diethanolamides of class (a) are especially preferred in that they give products having especially low cloud points. Detergent compositions containing dialkyl sulphosuccinates and diethanolamides are described and claimed in GB No. 2 130 236A (Unilever), published on 31 May 1984.

At the high active matter concentrations with which the invention is concerned, there is little room for other ingredients and these must be chosen with especial care. The predominant residual ingredient is preferably water, and this will include water inherently present in the detergent-active raw materials and the lower alcohol. Preferably at least 10% by weight of water is present, more preferably at least 15%. The various preferred levels of detergent-active agents quoted above are based on anhydrous (100% active matter) material.

The composition of the invention also contains a lower aliphatic alcohol, preferably isopropanol, glycerol or, above all, ethanol. This component is essential to ensure compatibility and solubility of the ingredients and to give a stable isotropic liquid. The amount of alcohol present will generally decrease as the total active detergent level increases: it is preferably at least 5% by weight, more preferably at least 7% by weight and advantageously at least 10% by weight. There is no particular upper limit for the alcohol content, other than that set by cost and enviromental considerations. We have generally found it possible and desirable to use less than 20% by weight of alcohol. A preferred range for alcohol content is 7 to 15% by weight.

The present invention is based on the discovery that the ratio of alcohol to water is of critical importance in the avoidance of phase separation.

The critical value r above which the alcohol to water ratio must lie for stability various with the total active detergent level. It is probable, too, that it will vary slightly with the dialkyl sulphosuccinate chain length, the ratio of dialkyl sulphosuccinate to alkyl ether sulphate, the countercation and the lower alcohol used. The values of r quoted in the present specification have been determined for a particular dialkyl sulphosuccinate mix containing di$C_6$, di$C_8$ and $C_6/C_8$ material, all in sodium salt form. The mixture was prepared as described in the aforementioned GB 2 108 520A (Unilever), by reacting a mixture of n-hexanol and n-octanol with maleic anhydride and subjecting the resulting mixture of dialkyl maleates to bisulphite addition. The starting alcohols were used in substantially equimolar proportions to give a so-called "statistical mixture" containing the di$C_6$, di$C_8$ and $C_6/C_8$ sulphosuccinates in molar proportions of approximately 1:1:2.

This mixture was used in conjunction with an alkyl ether sulphate in ammonium salt form, at a weight ratio of 2:1, and the lower alcohol used was ethanol. Precise details of all materials used are given in the Examples below.

For this system, the experimental work described in the Examples indicated that the critical ratio r lay within the following limits:

| Total active detergent A (weight %) | r |
|---|---|
| 60 | between 0.45 and 0.47 |
| 63 | about 0.53 |
| 66 | between 0.54 and 0.57 |
| 68 | between 0.56 and 0.59 |
| 70 | between 0.54 and 0.58 |

It would appear that the value of r rises with A to a maximum value at A=about 68%, then falls slightly.

Although this is clearly not a simple linear relationship, the 60–68% region fits reasonably well to the equation $$r=0.0136A-0.352$$

The calculated and observed values of r over this concentration range are as follows:

| A | r (calculated) | r (observed) |
|---|---|---|
| 60 | 0.464 | 0.45–0.47 |

-continued

| A | r (calculated) | r (observed) |
|---|---|---|
| 62 | 0.491 | |
| 63 | 0.505 | 0.53 |
| 66 | 0.546 | 0.54–0.57 |
| 66.5 | 0.552 | |
| 68 | 0.573 | 0.56–0.59 |

In general, it appears that the ratio of lower alcohol to water in the compositions of the invention should exceed 0.45, and should exceed a value r within the range of from 0.45 to 0.6.

There appears to be no particular benefit in increasing the alcohol to water ratio substantially above the critical value r. The ratio is preferably within the range of from r to 1.10, advantageously from r to 0.90.

High absolute levels of alcohol are not particularly desirable for cost and environmental reasons, and they also give compositions with low viscosities. High ratios of alcohol to water can cause the compositions to become saturated with respect to inorganic impurities present in the raw materials, so that these impurities precipitate out. Thus if detergent-active raw materials containing appreciable levels of inorganic impurities are used, it may be necessary to remove precipitated inorganic solids from the resulting compositions by filtration, centrifugation or decantation.

It is thus preferable, according to the invention, to formulate using the minimum level of alcohol consistent with an alcohol to water ratio above the critical value r and acceptable low-temperature stability. The optimum level in any particular case may readily be determined by routine experiment: this will decrease as the total active detergent level increases.

Conventionally liquid detergent compositions for light-duty applications contain hydrotropes, for example, urea or sodium xylene sulphonate, to increase the solubility of the active detergent constituents and generally to improve clarity and stability. The inclusion of urea in amounts not exceeding 12% by weight has been found to be beneficial to low temperature stability, and, surprisingly, also raises the viscosity.

The compositions of the invention may also contain the usual minor ingredients well-known to those skilled in the art, for example, colouring, perfume and germicides. These in total will not generally constitute more than about 2% by weight of the whole composition.

Owing to their relatively high alcohol content, the compositions of the invention do not have especially high viscosities, especially if urea is absent, and it may be desirable for reasons of consumer appeal to incorporate a thickening agent. GB No. 2 140 024 (Unilever), published on Nov. 21, 1984, describes and claims aqueous liquid detergent compositions having relatively low active matter levels and based on dialkyl sulphosuccinates, these compositions including certain polymers which simultaneously improve foaming performance and raise viscosity. The preferred polymers are hydrophilically substituted celluloses and guars, xanthan gums and various acrylic polymers.

Attempts to thicken the high-concentration high-alcohol compositions of the present invention with these and other polymers initially encountered considerable difficulties because most polymers were incompatible with, or insoluble in, the compositions. It was, however, found that two classes of polymer—hydroxypropyl guars (galactomannans) and polyethylene oxides—could be used successfully to thicken the compositions of the present invention.

Furthermore, it was subsequently found that hydrophilically substituted celluloses could also be used to thicken these concentrated compositions. Lower-molecular-weight materials of this class can be incorporated by direct addition, while higher-molecular-weight materials need to be incorporated by means of a particular procedure.

Accordingly, in a preferred embodiment, the compositions of the invention further comprise from 0.003 to 2.0% by weight of a polymer selected from hydroxypropyl guars, polyethylene oxides, and cellulosic polymers having hydrophilic substituents. The preferred polymer level for effective viscosity increase is from 0.02 to 1.0% by weight. At lower levels (0.003–0.02%) little or no measurable increase in viscosity at normal shear rates can be observed, but flow properties at very low shear rates are improved.

A first class of suitable polymers is constituted by the Jaguar (Trade Mark) range of hydroxypropyl guars ex Meyhall. Hydroxypropyl guars having a relatively high level of hydroxypropyl substitution are especially preferred. For example, Jaguar HP60, believed to have a substitution level (molar) less than or equal to 0.60, is more effective than Jaguar HP8, believed to have a lower substitution level.

A second class of polymers suitable for use in the compositions of the invention is constituted by the Polyox (Trade Mark) range of polyethylene oxides, ex Union Carbide.

A third class of polymers is constituted by cellulosic polymers having hydrophilic substituents. Especially preferred are celluloses substituted with hydroxyethyl or hydroxypropyl groups. Examples of such materials include the following:

| Trade Name | Manufacturer | Chemical type |
|---|---|---|
| Methocel* J,K,E and F | Dow | Hydroxypropyl methyl cellulose |
| Natrosol* | Hercules | Hydroxyethyl cellulose |
| Klucel* | Hercules | Hydroxypropyl cellulose |
| Bermocoll* | Berol Kemi | Ethyl hydroxyethyl cellulose |

*denotes Trade Mark

The Natrosol series of hydroxyethyl celluloses is especially preferred.

As indicated previously, the higher-molecular-weight grades of these cellulosic polymers are not very soluble in the compositions of the invention and are best incorporated by means of particular procedure. The process comprises the following steps:

(i) dissolving the cellulosic polymer in a quantity of water calculated to give the correct water level in the final composition, optionally in the presence of a part or the whole of the calculated quantity of the $C_2$–$C_3$ alcohol (b);

(ii) if necessary, adding a further part, the remainder or the whole of the calculated quantity of the $C_2$–$C_3$ alcohol (b);

(iii) mixing in the alkyl ether sulphate (a) (ii) and the optional nonionic detergent (a) (iii), plus any $C_2$–$C_3$ alcohol still to be added, (iv) mixing in the dialkyl sulphosuccinate (a) (i).

It will be seen that the polymer should be dissolved in water before mixing with the detergent-active materials: the non-sulphosuccinate detergent-active materials should be added before the sulphosuccinate; and the sulphosuccinate should be added only after the polymer, water, lower alcohol and other detergent-active materials have been mixed. The addition of the lower alcohol may be made at any suitable point provided that it is all incorporated before the sulphosuccinate is added. It may if desired be added in stages: some with the polymer, some after the polymer dissolution is complete and some with the non-sulphosuccinate detergent-active materials.

In accordance with a preferred procedure the polymer is dissolved in water alone, and the alcohol is added only when dissolution and swelling of the polymer are complete. The preferred process thus comprises the following steps:

(i) dissolving the cellulosic polymer in a quantity of water calculated to give the correct water level in the final composition, (ii) when dissolution is complete, adding the calculated quantity of the $C_2$–$C_3$ alcohol (b);

(iii) mixing in the alkyl ether sulphate (a) (ii) and the optional nonionic detergent (a) (iii); and (iv) mixing in the dialkyl sulphosuccinate (a) (i).

As previously indicated, the polymer is present in an amount of from 0.003 to 2.0% by weight, preferably from 0.05 to 1.0% weight. The amount of polymer required to attain a particular desired viscosity may be ascertained by means of a series of preliminary trial and error experiments using small samples.

In the preferred process outlined above, the cellulosic polymer is first dissolved in the calculated quantity of water. In making this calculation, the water already present in the detergent-active raw materials must be taken into account. Dissolution may be aided by the addition of a small quantity of alkaline reagent, for example, sodium hydroxide solution: some polymers, for example the Natrosols, are available in grades having a surface coating and the alkali accelerates dispersion by removing this coating. A very small quantity of alkali is generally sufficient.

The polymer swells considerably on contact with water and a highly viscous, gelatinous solution is obtained.

In the next stage, the calculated quantity of lower alcohol, generally ethanol, is added to the aqueous polymer solution. Again, in calculating the quantity of alcohol required the amounts present in the detergent-active raw materials must be taken into account. Addition of the alcohol causes the viscosity to drop sharply, for example, from about 100,000 cp to about 3000 cp.

The detergent-active agents other than the dialkyl sulphosuccinate—alkyl ether sulphate and optional nonionic surfactant—can now be mixed in, with efficient stirring. Ether sulphates are generally available as 60% or 70% active matter pastes, the former also containing 14% ethanol, so some water, and possibly alcohol, will be introduced at this point. The nonionic surfactant may be in 100% active matter form. A further drop in viscosity occurs at this stage, typically to about 300 cp.

After stirring well the mixture is ready for the addition of the dialkyl sulphosuccinate. Stirring is continued during the addition of the dialkyl sulphosuccinate and preferably for at least 15 minutes after addition is complete. Dye, perfume and other minor ingredients may then be added.

Clearly the more concentrated the raw materials used the more water can be used for the initial polymer dissolution step. Accordingly, the detergent-active raw materials should preferably themselves contain as little water as possible. In a preferred embodiment of the invention, the dialkyl sulphosuccinate raw material is a 77–90% active matter composition prepared in accordance with EP No. 140 710A (Unilever), published on 8 May 1985.

The invention is further illustrated by the following non-limiting Examples.

EXAMPLES

In the following Examples, as previously indicated, the dialkyl sulphosuccinate used was the $C_6/C_8$ statistical mixture referred to previously and described in the aforementioned GB No. 2 108 520 (Unilever): this is a mixture of approximately 25 mole % of di-n-hexyl sulphosuccinate, 25 mole % of di-n-octyl sulphosuccinate and 50 mole % of n-hexyl n-octyl sulphosuccinate (all sodium salts). It was in the form of an approximately 80% paste prepared as described in EP No. 140 710A (Unilever), published on 8 May 1985. Various batches having different levels of electrolytic impurities were used; in the individual Examples the total electrolyte levels in the compositions are given.

As previously indicated, the alkyl ether sulphate used was Dobanol 23-3A ex Shell ($C_{12}$–$C_{13}$, 3 EO, ammonium salt), in the form of an approximately 60% solution containing some ethanol and some electrolyte. These have been included in the total ethanol and electrolyte levels quoted.

The lower alcohol used was ethanol, in the form of industrial methylated spirit (90.6% by weight ethanol), but the figures quoted are for actual ethanol content. The figures for water content include that derived from the detergent-active raw materials themselves and from the industrial methylated spirit, and were calculated by subtraction from 100%.

All ingredient levels are quoted as the nominal figures for 100% material.

Examples 1 to 4

Liquid detergent compositions containing 60% active matter were prepared from the ingredients listed in the following Table.

| | 1 | 2 | A | 3 | B | 4 | C | D |
|---|---|---|---|---|---|---|---|---|
| Dialkyl sulphosuccinate | 40.0 | 40.0 | 40.0 | 40.0 | 40.0 | 40.0 | 40.0 | 40.0 |
| Ether sulphate | 20.0 | 20.0 | 20.0 | 20.0 | 20.0 | 20.0 | 20.0 | 20.0 |
| Ethanol | 13.1 | 12.7 | 12.2 | 15.0 | 12.2 | 15.0 | 12.2 | 10.3 |
| Electrolytic impurities | 0.42 | 0.42 | 0.42 | 0.55 | 0.55 | 1.24 | 1.24 | 1.24 |
| Water (to 100%) | 26.48 | 26.92 | 27.38 | 24.45 | 27.25 | 23.76 | 26.56 | 28.46 |
| Ethanol to water ratio | 0.50 | 0.47 | 0.45 | 0.61 | 0.45 | 0.63 | 0.46 | 0.36 |

It will be seen that at this total active detergent level the critical ethanol to water ratio lies between 0.45 and 0.47.

Compositions 1, 2 and 3 according to the invention were clear stable isotropic liquids. Composition 1 had a cloud point of 7° C. Reduction of the ethanol to water ratio below 0.464 resulted in unstable 2-phase compositions (Comparative Compositions A and B).

Composition 4 and Comparative Compositions C and D were prepared from a dialkyl sulphosuccinate raw material containing a higher level of electrolytic impurities. Composition 4 contained some precipitated solid, but this could be filtered off to give a clear isotropic solution which on analysis showed no loss of detergent-active material. It would therefore appear that the solids were inorganic.

Comparative Composition C, with the higher electrolyte level but otherwise corresponding to Comparative Composition A and B, was unstable and separated into two immiscible phases, and also contained precipitated solid. At an even lower ethanol to water ratio (Comparative Composition D) the precipitated solid had virtually disappeared but the composition was very unstable and separated into two phases.

Examples 5–7

Liquid detergent compositions containing 63% active matter were prepared as follows, using low-electrolyte dialkyl sulphosuccinate. It will be seen that at this concentration the critical ratio appears to lie between 0.52 and 0.56.

| | 5 | 6 | 7 | E | F | G |
|---|---|---|---|---|---|---|
| Dialkyl sulphosuccinate | 42.0 | 42.0 | 42.0 | 42.0 | 42.0 | 42.0 |
| Ether sulphate | 21.0 | 21.0 | 21.0 | 21.0 | 21.0 | 21.0 |
| Ethanol | 15.0 | 13.8 | 13.1 | 12.6 | 12.2 | 12.2 |
| Electrolytic impurities | 0.58 | 0.45 | 0.45 | 0.45 | 0.58 | 0.45 |
| Water (to 100%) | 21.42 | 22.75 | 23.42 | 23.98 | 24.22 | 24.35 |
| Ethanol to water ratio | 0.70 | 0.61 | 0.56 | 0.52 | 0.50 | 0.50 |

Compositions 5, 6 and 7 were stable isotropic liquids, Composition 5 having a cloud point of 8° C., while Comparative Compositions E, F and G were unstable and separated into two immiscible phases.

Examples 8 to 11

Liquid detergent compositions containing 63% active matter were prepared as follows, using a higher-electrolyte batch of dialkyl sulphosuccinate.

| | H | J | 8 | 9 | 10 | 11 |
|---|---|---|---|---|---|---|
| Dialkyl sulphosuccinate | 42 | 42 | 42 | 42 | 42 | 42 |
| Ether sulphate | 21 | 21 | 21 | 21 | 21 | 21 |
| Ethanol | 10.3 | 11.3 | 12.0 | 13.0 | 14.0 | 15.0 |
| Electrolytic impurities | 1.65 | 1.65 | 1.65 | 1.65 | 1.65 | 1.65 |
| Water (to 100%) | 25.05 | 24.05 | 23.15 | 22.25 | 21.25 | 20.35 |
| Ethanol to water ratio | 0.41 | 0.47 | 0.53 | 0.59 | 0.68 | 0.74 |

Taken together with the results of Examples 5–7, these results indicate that the critical ratio at this concentration is about 0.53.

Comparative Compositions H and J were both unstable and separated into two immiscible phases. Composition 8, having an ethanol to water ratio of 0.53, was a clear stable isotropic liquid having a cloud point of 7° C.

Further increases in the ethanol to water ratio, in Compositions 9, 10 and 11, gave no improvement in the cloud point, which remained at 7° C. Compositions 9 and 10 contained small amounts, and Composition 11 a larger amount, of precipitated solid which could be filtered off and appeared to be inorganic. It thus appears that at these ingredient levels and proportions there is no advantage in raising the ethanol to water ratio significantly above its critical value.

Examples 12 to 14

Liquid detergent compositions containing 66% active matter were prepared as follows, using low-electrolyte dialkyl sulphosuccinate.

| | 12 | 13 | 14 | K | L |
|---|---|---|---|---|---|
| Dialkyl sulphosuccinate: | 44 | 44 | 44 | 44 | 44 |
| Ether sulphate | 22 | 22 | 22 | 22 | 22 |
| Ethanol | 15.0 | 12.2 | 12.2 | 11.7 | 11.3 |
| Electrolytic impurities | 0.61 | 0.61 | 0.47 | 0.47 | 0.47 |
| Water (to 100%) | 18.39 | 21.19 | 21.33 | 21.81 | 22.23 |
| Ethanol to water ratio | 0.82 | 0.58 | 0.57 | 0.54 | 0.51 |

Compositions 12, 13 and 14 were clear stable isotropic liquids, the cloud point of Composition 12 being 11° C. Comparative Composition K and L were unstable and separated into two phases. The critical ratio thus appears to lie between 0.54 and 0.57.

Examples 15 & 16

Liquid detergent compositions containing 66% active matter were prepared as follows, using a higher-electrolyte batch of dialkyl sulphosuccinate.

| | M | 15 | 16 |
|---|---|---|---|
| Dialkyl sulphosuccinate | 44 | 44 | 44 |
| Ether sulphate | 22 | 22 | 22 |
| Ethanol | 10.3 | 12.2 | 15.0 |
| Electrolytic impurities | 1.36 | 1.36 | 1.36 |
| Water (to 100%) | 22.34 | 20.44 | 17.64 |
| Ethanol to water ratio | 0.46 | 0.60 | 0.85 |

Comparative Composition M was unstable and split into two immiscible phases. Compositions 15 and 16 were single phase isotropic systems containing some precipitated solid which could be removed by filtration without reduction of the active detergent level; the supernatant liquid was clear and stable in each case.

Examples 17 & 18

Some liquid detergent compositions containing 68% active detergent were prepared as shown below, using low-electrolyte dialkyl sulphosuccinate.

| | 17 | 18 | N | P |
|---|---|---|---|---|
| Dialkyl sulphosuccinate | 45.33 | 45.33 | 45.33 | 45.33 |
| Ether sulphate | 22.67 | 22.67 | 22.67 | 22.67 |
| Ethanol | 12.2 | 11.7 | 11.3 | 10.8 |
| Electrolytic impurities | 0.48 | 0.48 | 0.48 | 0.48 |
| Water (to 100%) | 19.32 | 19.80 | 20.26 | 20.73 |
| Ethanol to water ratio | 0.63 | 0.59 | 0.56 | 0.52 |

Compositions 17 and 18 were clear isotropic solutions while Comparative Compositions N and P were unstable and separated into two phases. The critical ration at this concentration thus appears to lie between 0.56 and 0.59.

Examples 19 & 20

Some liquid detergent composition containing 70% active detergent were prepared as shown below, using low-electrolyte dialkyl sulphosuccinate.

| | 19 | 20 | Q |
|---|---|---|---|
| Dialkyl sulphosuccinate | 46.67 | 46.67 | 46.67 |
| Ether Sulphate | 23.33 | 23.33 | 23.33 |
| Ethanol | 11.3 | 10.8 | 10.3 |
| Electrolytic impurities | 0.50 | 0.50 | 0.50 |
| Water (to 100%) | 18.20 | 18.71 | 19.20 |
| Ethanol to water ratio | 0.62 | 0.58 | 0.54 |

Compositions 19 and 20 were clear isotropic solutions while Comparative Composition Q was unstable and separated into two phases. The critical ratio at this concentration thus appears to lie between 0.54 and 0.58.

Examples 21–23

These Examples show the effect of including small proportions of urea in compositions containing 63% active detergent.

Examples 21 and 22 show the effect of partially replacing the water in Composition 5 (see previously) by urea. This of course raises the ethanol to water ratio without increasing the ethanol level.

| | 5 | 21 | 22 |
|---|---|---|---|
| Dialkyl sulphosuccinate | 42 | 42 | 42 |
| Ether sulphate | 21 | 21 | 21 |
| Urea | — | 2 | 4 |
| Ethanol | 15.0 | 15.0 | 15.0 |
| Electrolytic impurities | 1.65 | 1.65 | 1.65 |
| Water (to 100%) | 20.35 | 18.35 | 16.35 |
| Ethanol:water ratio | 0.74 | 0.82 | 0.92 |
| Cloud point (°C.) | 8 | 6 | 4 |

All three compositions were stable single-phase isotropic liquids and the incorporation of low levels of urea (2 and 4%) in place of water caused the cloud point to fall. All three compositions, however, contained precipitated solid, the level of this increasing as the water level was reduced. The precipitated solid could be removed without reduction of the active detergent level.

Example 23 and Comparative Example R show the effect of partially replacing ethanol in Composition 5 by urea.

| | 5 | 23 | R |
|---|---|---|---|
| Dialkyl sulphosuccinate | 42 | 42 | 42 |
| Ether sulphate | 21 | 21 | 21 |
| Urea | — | 2 | 4 |
| Ethanol | 15.0 | 13.1 | 11.3 |
| Electrolytic impurities | 1.65 | 1.65 | 1.65 |
| Water (to 100%) | 20.35 | 20.25 | 20.05 |
| Ethanol:water ratio | 0.74 | 0.65 | 0.56 |

Composition 23 was a stable isotropic liquid showing only slight solids precipitation. Increase of the urea level to 4% at the expense of ethanol (Comparative Composition R) caused phase separation, even though the ethanol:water ratio was still above the critical ratio (0.53). Thus urea, if present, should replace water rather than ethanol in the composition.

EXAMPLES 24 to 27

These Examples show the effect of including certain nonionic surfactants in a 63% active detergent system. The proportions used were 2:1:0.5, i.e. 36% dialkyl sulphosuccinate, 18% alkyl ether sulphate and 9% nonionic surfactant. The nonionic surfactants used were Ninol P-621, Empilan CDE, Empilan LDE and Dobanol 91-8, all identified previously. A higher-electrolyte dialkyl sulphosuccinate was used in Examples 24 and 25, and a lower-electrolyte material in Examples 26 and 27. All the nonionic surfactants had zero electrolyte content. All four compositions were stable to room temperature (20° C.) storage, had cloud points of 6° C. or below, and showed no tendency towards phase separation. All showed some solids precipitation but the solid could be removed without reduction of the active detergent content.

| | 24 | 25 | 26 | 27 |
|---|---|---|---|---|
| Dialkyl sulphosuccinate | 36 | 36 | 36 | 36 |
| Alkyl ether sulphate | 18 | 18 | 18 | 18 |
| Empilan CDE | 9 | — | — | — |
| Empilan LDE | — | 9 | — | — |
| Ninol P-621 | — | — | 9 | — |
| Dobanol 91-8 | | — | — | 9 |
| Electrolytic impurities | 1.41 | 1.41 | 0.42 | 0.42 |
| Ethanol | 15.0 | 15.0 | 15.0 | 15.0 |
| Water | 20.59 | 20.59 | 21.58 | 21.58 |
| Ethanol:water ratio | 0.73 | 0.73 | 0.70 | 0.70 |
| Cloud point (°C.) | 3 | 3 | 6 | 6 |

Examples 28 & 29

The procedure of Examples 24 to 27 was repeated at the higher total active detergent level of 66.5%. The results are shown below. Composition 28 shows a slight tendency to solids precipitation but the small amount of solid could be removed by centrifugation and this operation did not appear to reduce the active detergent content. The supernatant liquid, and Composition 29, were clear isotropic single-phase materials stable to storage at 20° C. The exceptionally low cloud point of Composition 28 will be noted.

| | 28 | 29 |
|---|---|---|
| Dialkyl sulphosuccinate: | 38.0 | 38.0 |
| Alkyl ether sulphate | 19.0 | 19.0 |
| Ninol P-621 | 9.5 | — |
| Dobanol 91-8 | — | 9.5 |
| Electrolytic impurities | 0.44 | 0.44 |
| Ethanol | 15.0 | 15.0 |
| Water | 18.06 | 18.06 |
| Ethanol:water ratio | 0.83 | 0.83 |
| Cloud point (°C.) | 1.0 | 8.5 |

Examples 30–34

These Examples show the beneficial effect of more substantial levels of urea on viscosity, in compositions containing 66% active detergent including coconut diethanolamide. It will be seen from Example 30 that the critical ethanol to water ratio is lowered by the presence of the diethanolamide: earlier Examples shows that at 66% active detergent containing only dialkyl sulphosuccinate and alkyl ether sulphate, an ethanol to water ratio of at least 0.54–0.57 was required to avoid phase separation.

In Examples 30 to 34 the alkyl ether sulphate used was Synperonic (Trade Mark) W3/65 ex ICI (mostly $C_{13}$ and $C_{15}$ with a small amount of $C_{10}$; ammonium salt).

The viscosities shown were measured with a Haake viscometer at 25° C. at a shear rate of 20 $s^{-1}$.

| | 30 | 31 | 32 | 33 | 34 |
|---|---|---|---|---|---|
| Dialkyl sulphosuccinate | 36.5 | 36.5 | 36.5 | 36.5 | 36.5 |
| Alkyl ether sulphate | 19.5 | 19.5 | 19.5 | 19.5 | 19.5 |
| Coconut diethanolamide | 10 | 10 | 10 | 10 | 10 |
| Urea | — | 8 | 10 | 12 | 8 |
| Boric acid | 2 | 2 | 2 | — | 4 |
| Ethanol | 10.0 | 10.0 | 10.5 | 9.5 | 9.5 |
| Perfume | 0.4 | 0.4 | 0.4 | 0.4 | 0.4 |
| Dye | 0.003 | 0.003 | 0.003 | 0.003 | 0.003 |
| Water | 21.6 | 13.6 | 11.1 | 12.1 | 12.1 |
| Ethanol:water ratio | 0.46 | 0.74 | 0.95 | 0.79 | 0.79 |
| Viscosity (cp) | 30 | 131 | 128 | 137 | 135 |

Examples 35–38

Some further compositions, similar to Compositions 30 to 34, were prepared with varying active detergent levels. The alkyl ether sulphate used was as in Examples 30–34. These compositions contained low levels of a hydroxypropyl guar, Jaguar HP60 (see previously), of which the molar level of substitution is believed to be less than or equal to 0.60. Comparison of Composition 35 with Composition 32 shows that inclusion of 0.075% of polymer raised the viscosity from 128 to 221 cp.

The very low levels of polymer used in Compositions 37 and 38 had no measurable effect on viscosity but were beneficial with respect to flow properties at very low shear rates. Polymer levels of 0.02% by weight and above have been found to have a measurable effect on viscosity.

EXAMPLE 39

Composition 5 (see previously) was thickened with the hydroxypropyl guar, Jaguar HP60, used in Examples 35–38. Without polymer, Composition 5 had a viscosity of 30 cp as measured with a Haake viscometer at 25° C. and a shear rate of 26.5 $s^{-1}$. With polymer, the corresponding figures were as follows:

| Polymer level (wt %) | Viscosity (cp) |
|---|---|
| 0.1 | 130 |
| 0.3 | 400 |
| 0.6 | 1000 |

| | 35 | 36 | 37 | 38 |
|---|---|---|---|---|
| Total active detergent | 66.0 | 64.0 | 68.0 | 72 |
| Dialkyl sulphosuccinate | 36.5 | 36.5 | 37 | 37 |
| Alkyl ether sulfate | 19.5 | 18.5 | 21 | 24 |
| Coconut diethanolamide | 10 | 9 | 10 | 11 |
| Urea | 10 | 7 | 8 | 8 |
| Boric acid | 2 | — | 2 | 2 |
| Ethanol | 10.5 | 14.5 | 10.25 | 9.1 |
| Jaguar HP60 | 0.075 | 0.02 | 0.0075 | 0.0075 |
| Perfume | 0.4 | 0.4 | 0.4 | 0.4 |
| Dye | 0.003 | 0.003 | 0.003 | 0.003 |
| Water | 11.0 | 14.0 | 11.3 | 8.5 |
| Ethanol:water ratio | 0.95 | 1.04 | 0.90 | 1.07 |
| Viscosity (cp) | 221 | 75 | 175 | about 200 |

No problems with polymer insolubility were encountered. Jaguar HP8, believed to have a lower molar substitution level, was only partially soluble (swollen) in Composition 5, and unsubstituted guars—Meyproguar CSA200/50 (Trade Mark) ex Meyhall and Emulgum SP 600 ex Lucas Meyer—were completely insoluble.

EXAMPLE 40

Composition 5 was thickened with a polyethylene oxide polymer, Polyox WSR301 (see previously). At a level of 0.5% the polymer was completely soluble and the thickened composition had a Haake viscosity at 25° C. and 26.5 $s^{-1}$ of 80 cp. Thus higher levels of this type of polymer than of the hydroxypropyl guars are apparently required to reach any desired viscosity.

COMPARATIVE EXAMPLE

The following Table lists a number of polymers disclosed in the aforementioned GB No. 2 140 024A (Unilever) and found to be insufficiently soluble, when incorporated directly into Composition 5, to be usable as thickening agents.

| Trade Name | Manufacturer | Chemical type | Solubility in Composition 5 |
|---|---|---|---|
| Methocel* A4M | Dow | Methyl cellulose | Insoluble |
| Methocel* J75MS | Dow | Hydroxypropyl methyl cellulose | Insoluble |
| Methocel* K15MS | " | Hydroxypropyl methyl cellulose | " |
| Methocel* E4M | " | Hydroxypropyl methyl cellulose | " |
| Methocel* F4M | " | Hydroxypropyl methyl cellulose | " |
| Natrosol* 250 HBR | Hercules | Hydroxyethyl cellulose | Slightly soluble |
| Bermocoll* 481 FQ | Berol Kemi | Ethyl hydroxyethyl cellulose | Insoluble |
| Bermocoll* 320 G | Berol Kemi | Ethyl hydroxyethyl cellulose | Slightly soluble |
| Klucel* HF | Hercules | Hydroxypropyl cellulose | Slightly soluble |
| Versicol* W25 | Allied Colloids | Linear polyacrylamide | Insoluble |
| Versicol* S25 | Allied Colloids | Linear sodium polyacrylate | Insoluble |
| Carbopol* 941 | B F Goodrich | Sodium polyacrylate (crosslinked) | Slightly soluble |
| Kelzan* S | Kelco | Xanthan gum | Insoluble |

*denotes Trade Mark

EXAMPLE 41

A composition similar to Composition 25 and thickened with a high-molecular weight hydroxyethyl cellulose incorporated by the preferred method of the invention was prepared. The ingredients were as follows:

| | 41 |
|---|---|
| Dialkyl sulphosuccinate | 36.5 |
| Alkyl ether sulphate | 18.5 |
| Empilan LDE | 9.0 |
| Perfume | 0.6 |
| Natrosol 250HHBR | 0.35 |
| Ethanol | 14.5 |
| Water | 20.55 |
| Ethanol:water ratio | 0.71 |

The Natrosol 250 HHBR, a high-molecular-weight hydroxyethyl cellulose having an average molar substitution level of 2.5, was first dissolved in the calculated quantity of water (20.55 parts, minus that already present in the detergent active raw materials and the industrial methylated spirit). A drop of concentrated sodium hydroxide solutions was added to aid dissolution. The polymer swelled on contact with water to give a highly viscous, gelatinous solubtion.

The calculated quantity of industrial methylated spirit was then added, causing a sharp drop in viscosity, and the alkyl ether sulphate and lauric diethanolamide were mixed in with efficient stirring. The dialkyl sulphosuccinate, as an 80% active matter paste, was then stirred in and stirring was continued for a further 15–20 minutes. Finally the perfume was added.

The composition was in the form of a stable homogeneous liquid at room temperature, having a Haake viscosity of 411 cp at 25° C. at a shear rate of 20 $s^{-1}$.

For comparison, a composition containing no polymer but otherwise identical was prepared by mixing. This composition was a clear isotropic liquid at room temperature and had a viscosity of 28 cp. An attempt was then made to raise the viscosity by direct addition of polymer, but only an insignificant amount of polymer would dissolve.

We claim:

1. A homogeneous foaming isotropic liquid detergent composition consisting essentially of (a) from 60 to 80% by weight of an active detergent system consisting essentially of (i) from 20 to 65% by weight of a water-soluble monovalent salt of a $C_3$–$C_{12}$ dialkyl ester of sulphosuccinic acid in which the alkyl groups may be the same or different, (ii) from 12 to 55% by weight of a monovalent salt of a $C_{10}$–$C_{18}$ alkyl ether sulphate, the ratio of (i) to (ii) being from 4:1 to 0.5:1, and (iii) optionally a nonionic detergent, in an amount not exceeding 15% by weight of the whole composition, (b) from 5 to 20% by weight of a $C_2$–$C_3$ mono- or polyhydric alcohol, (c) from 0 to 12% by weight of urea, and (d) water and minor ingredients to 100%, the ratio of alcohol (b) to water being less than 1.10 and exceeding a critical value r which is selected for the given active detergent system as the value of said ratio below which separation in two phases occurs, said value r being at least 0.45 and being dependent on the total active detergent concentration.

2. A composition as claimed in claim 1, wherein the ratio of alcohol (b) to water is within the range of from about 0.45 to 0.90.

3. A composition as claimed in claim 1, wherein the ratio of alcohol (b) to water exceeds a critical value r within the range of from 0.45 to 0.6.

4. A composition as claimed in claim 1, wherein the ratio of alcohol (b) to water is less than 0.90.

5. A composition as claimed in claim 1, which contains at least 7% by weight of the alcohol (b).

6. A composition as claimed in claim 1, which contains at least 10% by weight of the alcohol (b).

7. A composition as claimed in claim 1, which contains from 5 to 20% by weight of the alcohol (b).

8. A composition as claimed in claim 7, which contains from 7 to 15% by weight of the alcohol (b).

9. A composition as claimed in claim 1, wherein the $C_2$–$C_3$ alcohol comprises ethanol.

10. A composition as claimed in claim 1, wherein the dialkyl sulphosuccinate (i) comprises material of at least two different alkyl chain lengths.

11. A composition as claimed in claim 10, wherein the dialkyl sulphosuccinate (i) comprises a mixture of symmetrical and unsymmetrical dialkyl sulphosuccinates.

12. A composition as claimed in claim 1, wherein the dialkyl sulphosuccinate (i) consists wholly or predominantly of straight-chain material.

13. A composition as claimed in claim 1, wherein the alkyl groups of the dialkyl sulphosuccinate (i) each have from 4 to 10 carbon atoms.

14. A composition as claimed in claim 13, wherein the alkyl groups of the dialkyl sulphosuccinate (i) each have from 6 to 8 carbon atoms.

15. A composition as claimed in claim 1, wherein the total active detergent concentration is within the range of from 60 to 70% by weight.

16. A composition as claimed in claim 15, wherein the total active detergent concentration is within the range of from 63 to 70% by weight.

17. A composition as claimed in claim 1, wherein the ratio of dialkyl sulphosuccinate (i) to alkyl ether sulphate (ii) is within the range of from 2.5:1 to 1.5:1.

18. A composition as claimed in claim 1, which includes as an optional nonionic detergent a $C_{10}$–$C_{18}$ alkyl di($C_2$–$C_3$ alkanol)amide in an amount from 7 to 15% by weight.

19. A composition as claimed in claim 1, which further comprises from 0.003 to 2.0% by weight of a polymer selected from the group consisting of hydroxypropyl guars, polyethylene oxides, and cellulosic polymers having hydrophilic substituents.

20. A composition as claimed in claim 19, wherein the polymer comprises hydroxyethyl cellulose or hydroxypropyl cellulose.

21. A composition as claimed in claim 19, which comprises from 0.02 to 1.0% by weight of the polymer.

22. A process for the preparation of a composition as claimed in claim 1 and further comprising from 0.003 to 2.0% by weight of a cellulosic polymer having hydrophilic substituents, which process comprises the steps of:

(i) dissolving the cellulosic polymer in a quantity of water calculated to give the correct water level in the final composition, optionally in the presence of a part or the whole of the calculated quantity of the $C_2$–$C_3$ alcohol (b);

(ii) if necessary, adding a further part, the remainder or the whole of the calculated quantity of the $C_2$–$C_3$ alcohol (b);

(iii) mixing in the alkyl ether sulphate (a) (ii) and the optional nonionic detergent (a) (iii), plus any $C_2$–$C_3$ alcohol still to be added;

(iv) mixing in the dialkyl sulposuccinate (a) (i).

23. A process for the preparation of a composition as claimed in claim 1 and further comprising from 0.003 to 2.0% by weight of a cellulosic polymer having hydrophilic substituents, which process comprises the steps of:

(i) dissolving the cellulosic polymer in a quantity of water calculated to give the correct water level in the final composition;

(ii) adding the calculated quantity of the $C_2$-$C_3$ alcohol (b);

(iii) mixing in the alkyl ether sulphate (a) (ii) and the optional nonionic detergent (a) (iii);

(iv) mixing in the dialkyl sulphosuccinate (a) (i).

* * * * *